US009297132B2

(12) United States Patent
Thompson

(10) Patent No.: US 9,297,132 B2
(45) Date of Patent: Mar. 29, 2016

(54) TURTLE FRIENDLY BEACH CLEANING DEVICE

(71) Applicant: WD Thompson Inc., Pompano Beach, FL (US)

(72) Inventor: Raymond Thompson, Ft. Lauderdale, FL (US)

(73) Assignee: WD THOMPSON INC., Pompano Beach, FL (US)

( * ) Notice: Subject to any disclaimer, the term of this patent is extended or adjusted under 35 U.S.C. 154(b) by 9 days.

(21) Appl. No.: 14/089,944

(22) Filed: Nov. 26, 2013

(65) Prior Publication Data

US 2015/0144362 A1 May 28, 2015

(51) Int. Cl.
*E01H 12/00* (2006.01)

(52) U.S. Cl.
CPC ..... *E01H 12/00* (2013.01)

(58) Field of Classification Search
CPC ..... A01B 43/00; E01H 12/00; E01H 12/002; E01H 12/004
USPC ..... 172/197, 799.5
See application file for complete search history.

(56) References Cited

U.S. PATENT DOCUMENTS 119,397 A * 9/1871 Parkman ..... 172/197
255,978 A * 4/1882 Harvey ..... 172/150
615,284 A * 12/1898 Kountz ..... A01B 31/00 172/200
976,811 A * 11/1910 Kloss ..... 171/86
1,578,600 A 3/1926 Henry
2,419,154 A * 4/1947 O'Brien ..... 171/98
2,839,851 A * 6/1958 Geiszler ..... E02F 3/7604 172/145
2,895,557 A * 7/1959 Davis ..... 171/63
3,010,523 A 11/1961 Harry
3,058,243 A * 10/1962 McGee ..... A01B 35/14 172/197
3,274,712 A * 9/1966 Jones ..... E02F 3/7604 172/197
3,448,814 A * 6/1969 Jackson et al. ..... 172/149
3,470,964 A * 10/1969 Collins ..... A01B 31/00 172/197
3,891,035 A * 6/1975 Miller ..... A01B 49/02 172/197
4,050,518 A 9/1977 Gilmour
4,127,949 A * 12/1978 Sabrowsky et al. ..... 37/221

(Continued)

FOREIGN PATENT DOCUMENTS

EP 277739 A1 8/1988
EP 0704146 B1 5/2000

(Continued)

OTHER PUBLICATIONS

Beach Cleaning Permit Conditions for all Counties Excluding Brevard through Broward and Monroe County, Florida Fish and Wildlife Conservation Commission, Aug. 15, 1996.

(Continued)

*Primary Examiner* — Matthew D Troutman
(74) *Attorney, Agent, or Firm* — Ferris H. Lander, Inc.

(57) ABSTRACT

A sea turtle friendly beach cleaning assembly designed for removal of seaweed and other debris from a sand beach. The device includes a beach raking assembly including a plurality of tines, in conjunction with a drag bar and a wire basket. When pulled across a sand surface, the device functions by pulling a plurality of "S" shaped tines across the sand surface in a substantially non-invasive manner, thereby eliminating any possible damage to turtle nests. The cooperation of the tine assembly and drag bar function to leave behind a smooth and clean surface free of ruts that would otherwise impede the movements of turtles and hatchlings.

2 Claims, 5 Drawing Sheets

(56) References Cited

U.S. PATENT DOCUMENTS

| | | | | | |
|---|---|---|---|---|---|
| 4,359,103 | A | * | 11/1982 | Heitman | E02F 3/815 172/197 |
| 4,364,434 | A | | 12/1982 | Erholm | |
| 5,060,732 | A | | 10/1991 | Baskett | |
| 5,265,975 | A | * | 11/1993 | Scott | E01C 23/082 172/197 |
| 5,407,014 | A | * | 4/1995 | Tranmer | 172/197 |
| 5,437,333 | A | * | 8/1995 | McPherson et al. | 171/19 |
| D364,174 | S | * | 11/1995 | McPherson et al. | D15/27 |
| 5,511,625 | A | * | 4/1996 | Mork | 172/445.1 |
| 5,630,476 | A | | 5/1997 | Foster | |
| 5,794,714 | A | * | 8/1998 | Brown | 172/799.5 |
| 5,833,011 | A | * | 11/1998 | Boertlein | 172/149 |
| 5,911,279 | A | * | 6/1999 | Whitener | A01B 63/10 172/668 |
| 6,094,847 | A | | 8/2000 | Gallenberg | |
| 6,330,784 | B1 | * | 12/2001 | Kutach et al. | 56/375 |
| 6,474,007 | B1 | * | 11/2002 | Sueshige et al. | 37/266 |
| 6,634,434 | B2 | | 10/2003 | Ohzeki | |
| 6,640,906 | B2 | | 11/2003 | Ohzeki | |
| 7,086,216 | B2 | | 8/2006 | Geraghty | |
| 7,506,692 | B2 | | 3/2009 | Barber | |
| 8,109,342 | B2 | | 2/2012 | Asao | |
| 8,657,024 | B2 | * | 2/2014 | Fraley | A01B 31/00 172/196 |
| 2007/0227750 | A1 | | 10/2007 | Shokichi | |
| 2011/0278032 | A1 | * | 11/2011 | Sundhagen et al. | 172/246 |

FOREIGN PATENT DOCUMENTS

| | | | |
|---|---|---|---|
| EP | 1842969 | B1 | 3/2013 |
| JP | 2002356827 | A | 12/2002 |
| JP | 2002371526 | A | 12/2002 |

OTHER PUBLICATIONS

Tractor Box Blades, retrieved from www.tractorboxblades.com, Dec. 31, 2015.

* cited by examiner

TURTLE FRIENDLY BEACH CLEANING DEVICE

FIELD OF THE INVENTION

This invention relates to beach cleaning devices, particularly to beach raking devices designed to comply with the requirements associated with beach raking in the presence of nesting sea turtles.

BACKGROUND OF THE INVENTION

Beach raking is a common maintenance duty. Beach raking devices exist which utilize tines or brushes to dig small furrows into the sand surface as they are dragged across a beach, leaving a freshly combed appearance. This type of raking is sufficient for most locales, however the nature of such a cleaning process is problematic in the presence of nesting sea turtles.

The Florida Department of Environmental Protection (FDEP) regulates mechanized beach cleaning under the Florida Beach & Shore Preservation Act, Florida Statute 161. In order for beach cleaning to occur during nesting season, FDEP have developed special conditions to protect marine turtles, their nests and hatchlings Because of the high density of turtle nests in Brevard through Broward Counties, special protection measures are required during the sea turtle nesting season (March 1 through October 31).

In accordance with Florida Statute 161m it is required that:

Cleaning equipment must not penetrate more than two inches into the beach surface;

All material collected must be removed from the beach;

In order to avoid adverse impacts in the event that cleaning accidentally occurs over a nest, mechanical beach cleaning equipment shall not penetrate more than two inches into the surface of the beach;

Mechanized beach cleaning shall be accomplished so that no ruts are formed on the beach; and Burial or storage of any debris (biotic or abiotic) collected is prohibited seaward of the 50 foot setback. Removal of accumulated debris from the beach must occur immediately after cleaning has been performed.

The present inventors have developed a turtle friendly beach raking apparatus which addresses a long felt need for a beach raking device that solves the problem of maintaining clean and pristine beaches while simultaneously preserving and protecting sea turtle nests and the hatchlings which emanate therefrom.

DESCRIPTION OF THE PRIOR ART

US Published Application 2007/227750 discloses a beach raking vehicle for beaching cleaning, which comprises a plurality (e.g., 15) of longitudinal members, each extending along the traveling direction and a plurality of sand pins, which are detachably attached to each of the longitudinal members such that the sand pins 23 protrude downward.

U.S. Pat. No. 5,630,476 discloses a rock racking apparatus for a self-propelled vehicle such as a skid steer loader, which comprises an apparatus adapted to be attached to the hydraulic arm of a loader and has a rock raking unit with a toothed rotor and a rock collector bucket connected to the raking unit.

U.S. Pat. No. 6,094,847 discloses a method and apparatus for cleaning beaches or other similar sandy areas, which comprises a digger chain and an associated sweeper chain for capturing debris and other articles and conveying the same to a collection box or separation conveyor and includes tines and a basket for removing the debris.

EP 0704146B1 discloses a device for cultivation of the soil, which comprises both c-shaped and s-shaped tines for furrowing the earth. The tines comprise a plurality of such working implements that are removably attached side by side to the frame of a harrow, cultivator or sowing machine to carry out harrowing, cultivating, and sowing, respectively.

U.S. Pat. No. 4,364,434 discloses a bucket mounted ground-raking and rock-gathering attachment for loaders, which comprises hydraulic cylinders for lifting and lowering the bucket and hydraulic cylinders on the tractor which are operated to rotate the bucket, for dumping the debris, while the attachment is substantially maintained in position.

JP 2002356827 discloses a beach cleaner, which comprises a travelling body grounded on a sand surface by ski members arranged at the four corner sections of an approximately quadrilateral frame and pulled by a tractor.

EP 1842969B1 discloses a beach cleaner towed by a tractor, which comprises a pair of trapezoid structures (41 L, 41 R) each formed by a grounded member (43) and a mountain-shaped guide member (44) provided on the grounded member (43) and on which the beach cleaner (20, 50) is allowed to ride, the trapezoid structures (41 L, 41 R) being composed of a plurality of divided bodies (41 a, 41 b, 41 c, 41 d) attachable to and detachable from each other.

U.S. Pat. No. 8,109,342 discloses a box-shaped beach-cleaning trailer, which comprises a towed vehicle for beach-cleaning and which has a litter collection trailer like vehicle which unit is towed by a vehicle to collect small pieces of litter which may be swept up from the sand to the trailer's container.

U.S. Pat. No. 6,640,906 discloses a beach cleaner for debris on a sandy surface, which comprises a towed vehicle for gathering and collecting debris from a beach and which has tines for pushing the debris into the gathering receptacle and which has two internal combustion engines for powering the tines.

U.S. Pat. No. 4,050,518 discloses a beach cleaner with an interchangeable ground engaging blade member, which comprises a blade member extending outwardly of the forward end and has a rotating rotor that moves debris from the beach to the debris holder for disposing of at a convenient time.

U.S. Pat. No. 5,060,732 discloses a ground raking attachment for a bucket-equipped tractor, which comprises a toothed, cylindrical rotor which works the soil and at the same time rakes the ground free of rocks, refuse, roots, sticks and other debris which is transferred to the tractor bucket by the action of the rotor.

U.S. Pat. No. 7,506,692 discloses a tine raking device assigned to H. Barber and Sons of Naugatuck, Conn. The tine raking device includes a frame and a conveyor assembly supported on the frame. The conveyor assembly has a conveyor belt defining perforations sized to allow passage there through of granules of sand and to prevent passage there through of larger sized debris to be removed from a ground surface. Flexible tines extending outwardly from the conveyor belt. The tines are arranged in rows across a width of the conveyor belt. The rows each are longitudinally spaced from adjacent rows along the conveyor belt such that a generally unimpeded path is defined along an outer surface of the conveyor belt for debris to flow between adjacent tines along an associated row. The conveyor assembly includes a lower section for permitting the tines to contact and remove debris from a ground surface being cleaned, and an inclined section for lifting debris on the conveyor belt away from the ground surface being cleaned.

The reference citations fail to teach or suggest the invention as disclosed and claimed herein. All of the references included supra appear to substantially penetrate the sand, and do not contemplate an arrangement whereby the sand is left smooth and unfurrowed, as required by Florida law during periods of turtle nesting.

SUMMARY OF THE INVENTION

The present invention is directed toward a beach cleaning assembly that is designed to remove seaweed and other debris from a sand beach. The device includes a beach raking assembly including a plurality of tines forming a tine assembly, in conjunction with a drag bar and a wire basket. When pulled across a sand surface, the device functions by pulling a plurality of "S" shaped tines across the sand surface in a substantially non-invasive manner, thereby eliminating any possible damage to turtle nests. The cooperation of the tine assembly and drag bar function to leave behind a smooth and clean surface free of ruts that would otherwise impede the movements of turtles and hatchlings.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
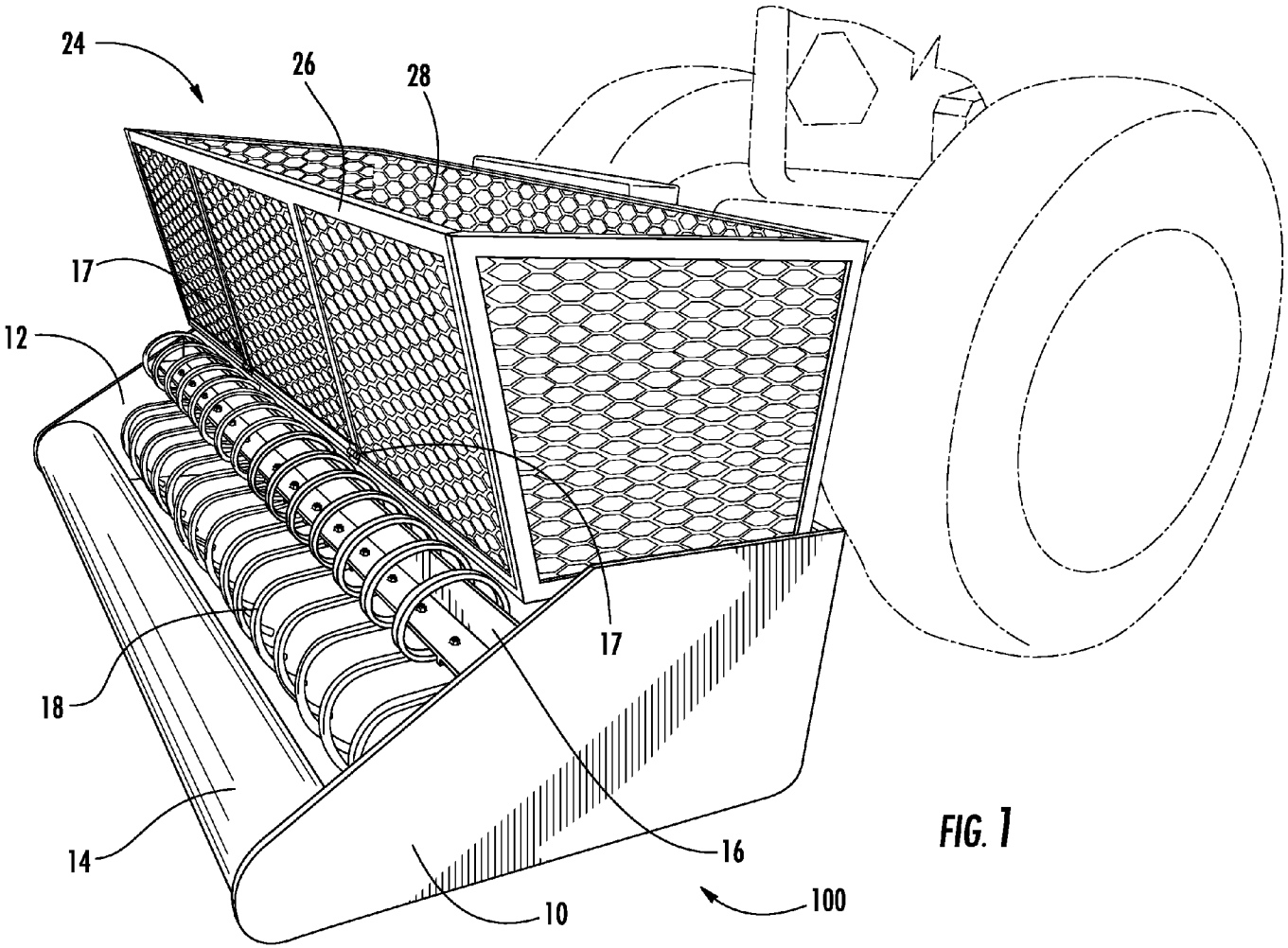
FIG. 1 is a rear perspective view of the beach cleaning assembly.
Figure 6:
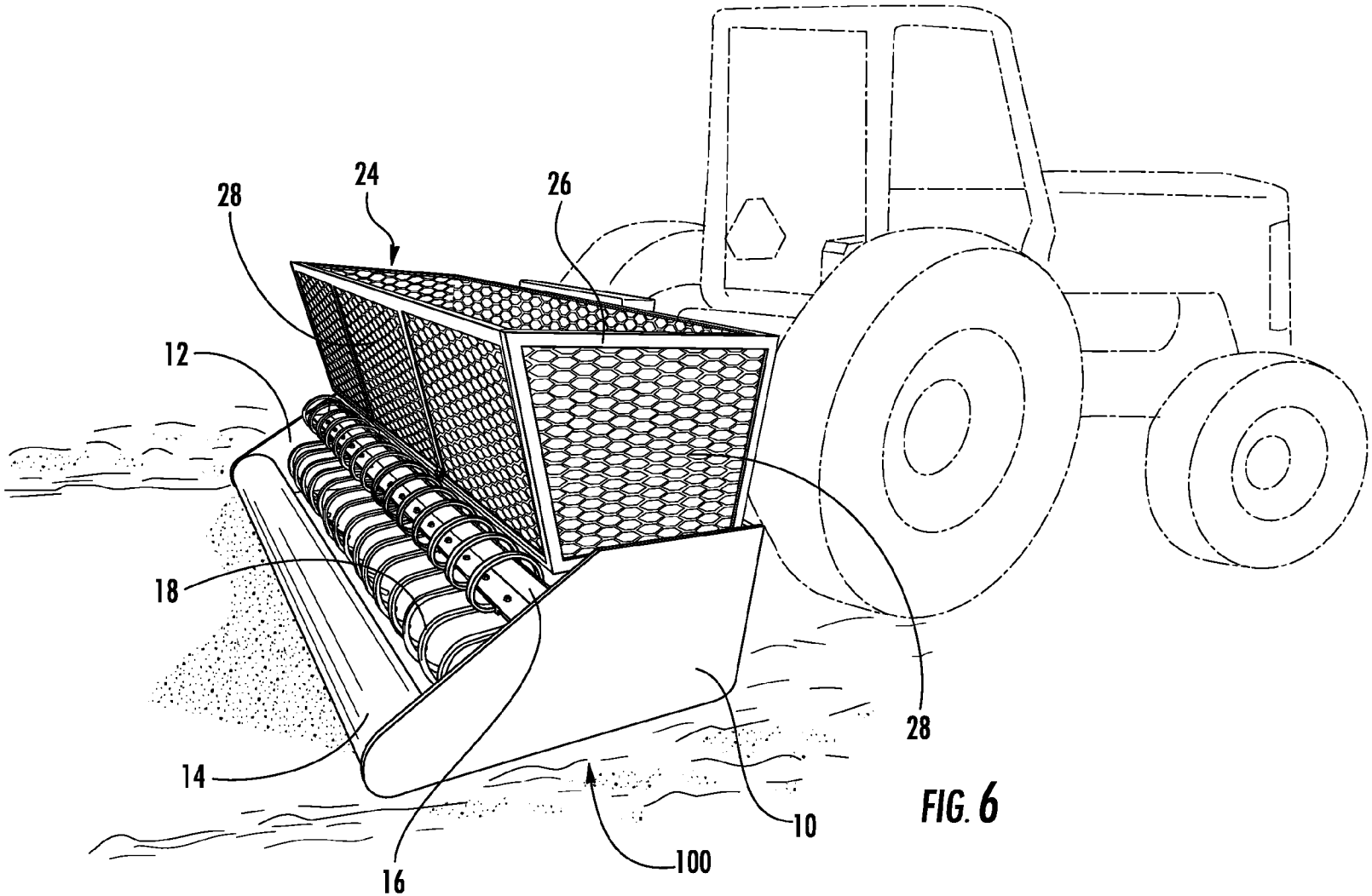
FIG. 6 is a rear perspective view of the beach cleaning assembly in use on a beach.

With reference to FIGS. 1 and 6, in one embodiment the invention is directed toward a beach cleaning assembly 100, which is dragged behind a tractor or the like (shown in phantom lines) to gather seaweed and other debris. The beach cleaning assembly 100 is constructed of a first side plate and a second side plate 10 and 12, each said side plate having a front edge, a back edge, a top edge, a bottom edge, an inner face, and an outer face. The side plates 10 and 12 are positioned in a spaced apart, substantially parallel relationship, and are maintained in such relationship by their attachment to several supporting components. The supporting components include a drag bar 14, positioned between said first side plate 10 inner face and said second side plate 12 inner face, in proximity to each said back edges thereof. The drag bar 14 is positioned essentially perpendicular to the inner faces of each of said side plates 10 and 12. In an embodiment the drag bar 14 is formed from an 8" Schedule 40 steel pipe, although alternative sizes and material components are contemplated by the invention. A further supporting component which assists in stabilizing sides 10 and 12 is tine support bar 16, which in one embodiment may be formed from a 3"×3" angle iron. The tine support bar 16 is positioned between said first side plate 10 inner face and said second side plate 12 inner face, in proximity to each said top edges thereof, said tine support bar being substantially perpendicular to said first and second side plate inner faces. The tine supporting bar 16 has a plurality of "S" shaped tines 18 attached thereto. Said plurality of "S" shaped tines 18, are affixed in spaced relation along said tine support bar, said tines being positioned in relation to said drag bar to prevent penetration of greater than two inches (2") into said sand beach.

In an embodiment, one or more stop members 22 are affixed to the tine support bar 16 proximate each tine, and are positioned to prevent twisting of the tines during use. Steel side plates 10 and 12 act to contain spill out of the collected seaweed.

In an embodiment, the beach cleaning device 100 is fabricated with a crisscross pattern style rake basket 24, which is mounted on top of the tines 18 to hold trashcans and large objects (not shown) that are gathered from the beach. The steel sides 10 and 12 of the device 100 and the basket 24 on top of the tines 18, provide for containment of the seaweed within the device 100, allowing for larger piles of seaweed to be collected. The rake basket 24 is mounted on hinges 17 so it can be tipped toward the rear so one person can load large items into the rake basket 24 and to allow for maintenance of the tines 18 and rake basket 24.

When being dragged across a beach, as more clearly illustrated in FIG. 6, the drag bar 14 allows for a small amount of sand to be built up between the tines 18 and the pipe 14 to prevent seaweed from escaping past the tines 18 and falling out the rear of the unit. This gives the beach a "groomed appearance" and also satisfies the Florida Department of Environmental Protection (FDEP) regulation for mechanical beach cleaning during turtle nesting season which states that no tine marks or tire tracks be left in the sand after mechanical cleaning of the beach so as to allow turtle hatchlings to make their way from the sandy beach to the surf without getting trapped in ruts.

The FDEP permit conditions also states that mechanical cleaning devices must not penetrate the sand to more than two inches in depth. The present configuration of the drag bar 14, which is mounted two inches below the tines 18, allows the drag bar 14 to make contact with the sand first leaving the "S" tines 18 to skim the sand and gather the seaweed on the surface with little or no penetration of the sand.

In an embodiment, the rake basket 24, by using a 3# steel grating, enables the operator of the device to put trash like soda cans and bottles directly in the basket. Once the device is complete, the basket 24 may be hot dip galvanized to prevent corrosion and extend the life of the basket with a pleasant appearance.

Figure 2:
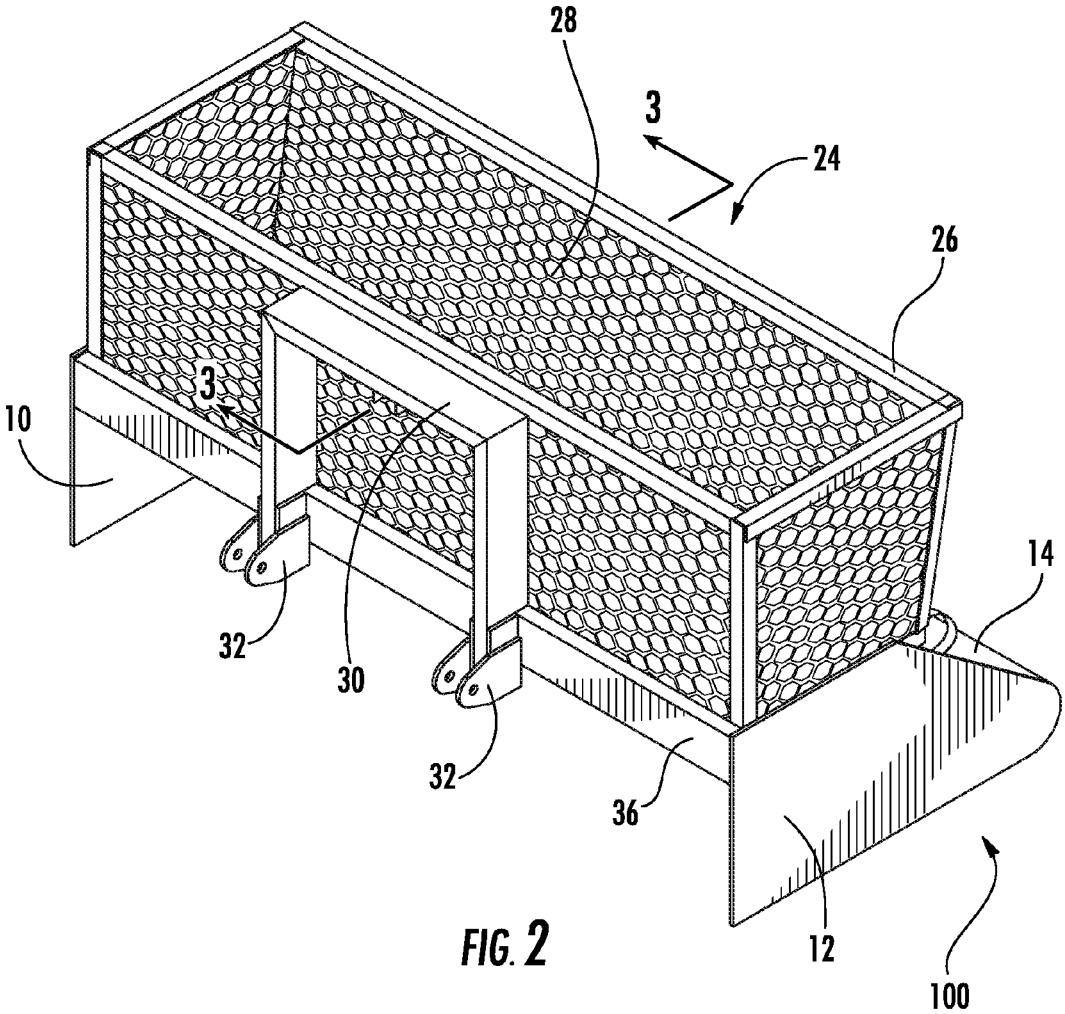
FIG. 2 is a front perspective view of the beach cleaning assembly.

Referring to FIG. 2, a front perspective view an embodiment of the beach cleaning device 100 is illustrated. Rake basket 24 is positioned between said first and second side plate 10,12 inner faces proximate to each said top edge thereof, and is formed from frame 26 and steel grating 28. Lift frame 30 is shown having lift hooks 32 and is adapted for attachment to a towing vehicle, e.g. a tractor or the like.

Figure 3:
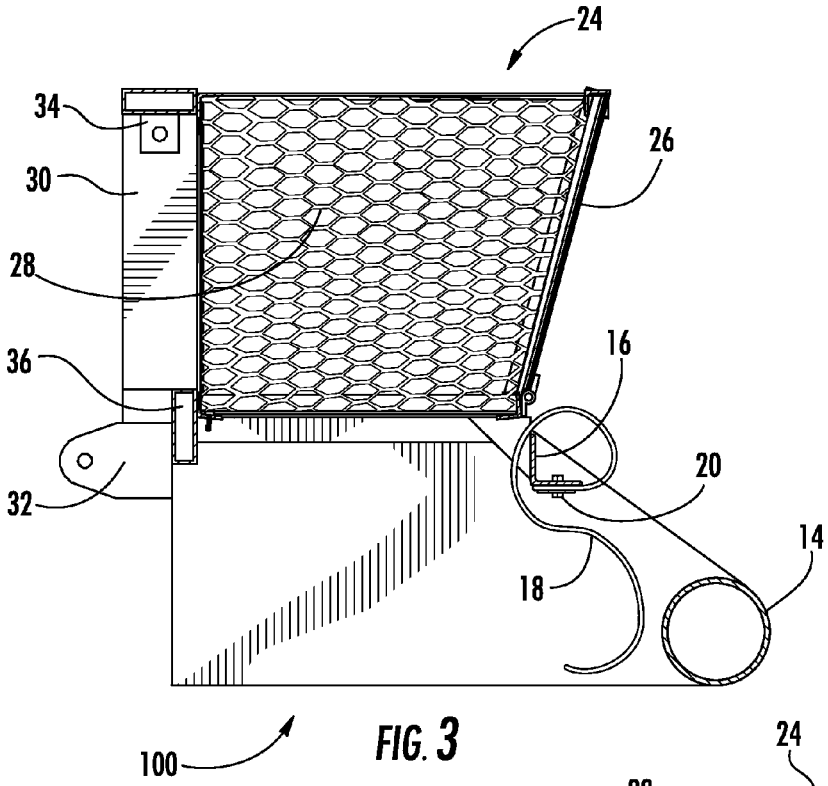
FIG. 3 is a cross-section of the beach cleaning assembly taken through Section Line 3-3 of FIG. 2.

Now referring to the cross-sectional view taken along line 3-3 of FIG. 2, FIG. 3 shows hitch attachment plates 34. This figure clearly depicts the attachment of "S" tines 18 to tine supporting bar 16 via fastener 20. This figure also illustrates the 2" height differential between the bottom of drag bar 14 and the lowermost portion of tines 18. Cross-member 36 is shown which helps to provide additional stability at the front of the beach cleaning device 100.

Figure 4:
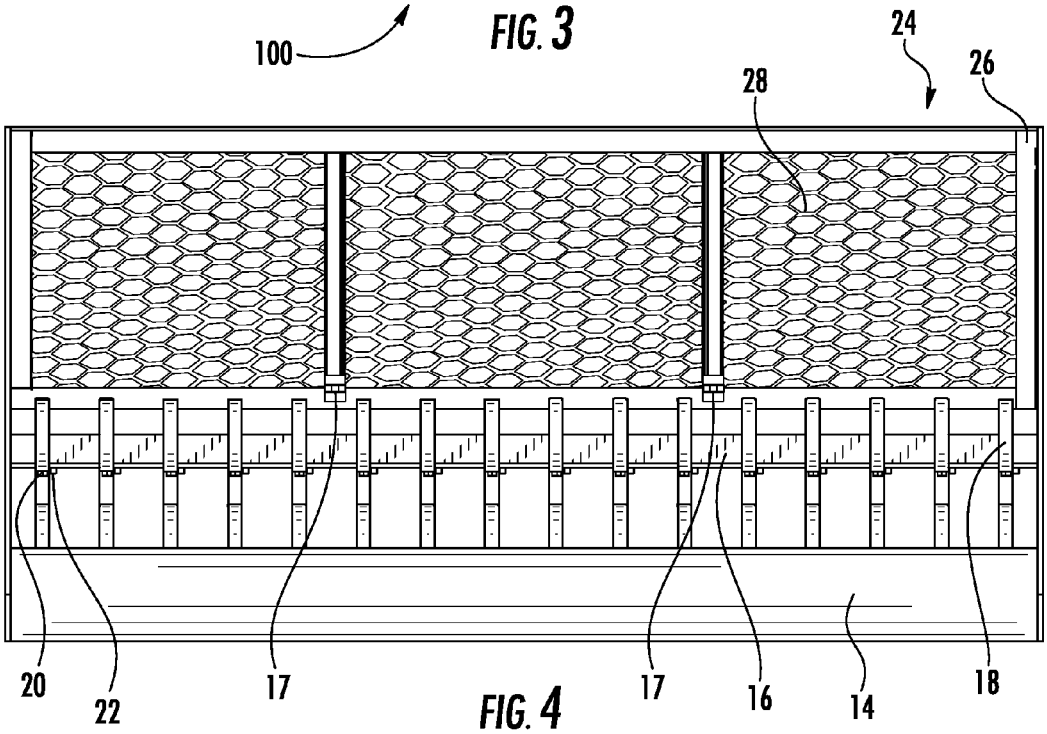
FIG. 4 is a rear view of the beach cleaning assembly.

With further reference to FIG. 4, a rear view of the device permits visualization of the relationship between the drag bar 14, tines 18, tine support bar 16, and rake basket 24. Hinges 17 are illustrated herein, which permit tipping of rake basket 24 to permit easy emptying and to allow convenient access to the area enclosing tines 18.

Figure 5:
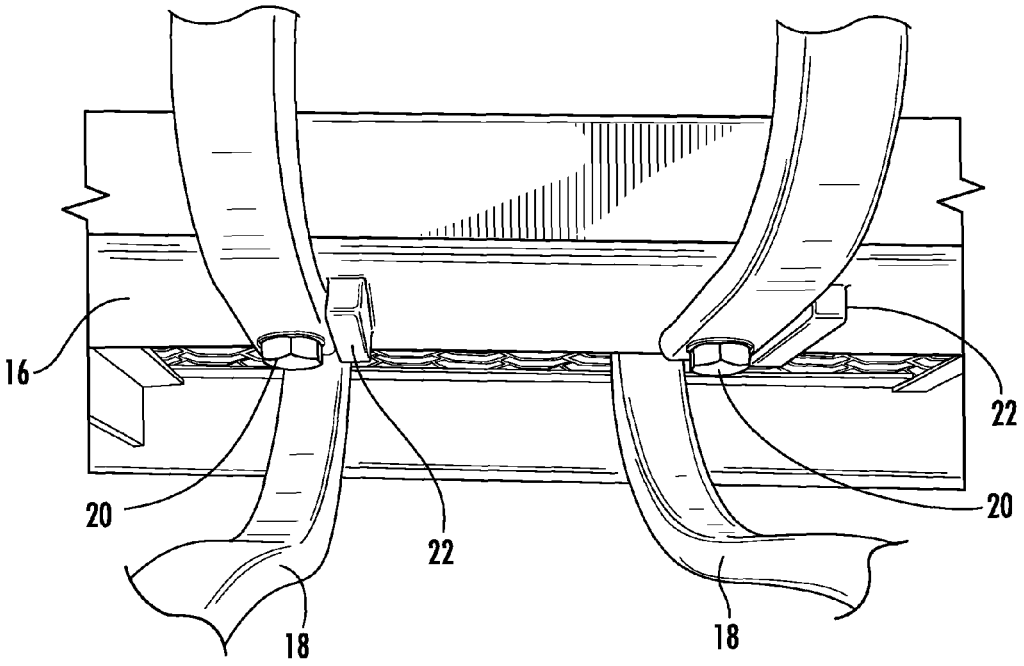
FIG. 5 is a magnified view of the tines and tine support connection.

FIG. 5 is a close in view of the tine assembly, inclusive of tine support bar 16, which illustrates a typical attachment of adjacent "S" shaped tines 18 to tine supporting bar 16, via fasteners 20, e.g. a nut and bolt, rivet, weldment, or the like. The interaction of stop members 22 to eliminate twisting of the tines 18 is also illustrated is also shown.

As depicted in FIG. 6, as the device 100, is dragged across a beach, the device 100 settles into the sands surface as it is pulled across. The components, particularly drag bar 14, and first and second side plates 10 and 12, interact with the sand to seal off the central portion of the assembly 100 which houses the tines 18 preventing spill out of the seaweed which is being collected, while allowing the "s" shaped tines 18 to skim over the surface of the sand, and pushing a small build-up of sand ahead of the drag bar to facilitate seaweed collection, and result in a furrow-free cleaned area behind the device.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A beach cleaning assembly for cleaning a sand beach, said beach cleaning assembly adapted for attachment to a towing vehicle, and consisting of, in combination:

a first side plate and a second side plate, said side plates in spaced apart relationship, each said side plate having a front edge, a back edge, a top edge, a bottom edge, an inner face, and an outer face;

a drag pipe, fixedly positioned between said first side plate inner face and said second side plate inner face, proximate to each said back edge thereof, said drag pipe being substantially perpendicular to said first and second side plate inner faces;

a tine support bar positioned between said first side plate inner face and said second side plate inner face, proximate to each said top edge thereof, said tine support bar being substantially perpendicular to said first and second side plate inner faces;

a plurality of "S" shaped tines, affixed in spaced relation along said tine support bar, said tines being fixedly positioned in relation to said drag pipe to prevent penetration of greater than two inches (2 ") into said sand beach; and a plurality of stop members affixed to said tine support bar proximate and adjacent to each tine, and positioned to prevent twisting of said tines during use;

wherein said drag pipe is constructed and arranged to allow for an amount of sand to be built up between the tines and the drag pipe which is effective to prevent seaweed or other debris from escaping past the tines and exiting from the rear of the unit upon being pulled along a sand beach, whereby debris is removed from the sand's surface leaving behind a smooth surface that is free of ruts.

2. A beach cleaning assembly for cleaning a sand beach consisting of, in combination:

a first side plate and a second side plate, said side plates in spaced apart relationship, each said side plate having a front edge, a back edge, a top edge, a bottom edge, an inner face, and an outer face;

a drag pipe fixedly positioned between said first side plate inner face and said second side plate inner face, proximate to each said back edge thereof, said drag pipe being substantially perpendicular to said first and second side plate inner faces;

a tine support bar positioned between said first side plate inner face and said second side plate inner face, proximate to each said top edge thereof, said tine support bar being substantially perpendicular to said first and second side plate inner faces;

a plurality of "S" shaped tines, affixed in spaced relation along said tine support bar, said tines being fixedly positioned in relation to said drag bar to prevent penetration of greater than two inches (2") into said sand beach;

a plurality of members affixed to said tine support bar proximate and adjacent each tine, and positioned to prevent twisting of said tines during use;

a rake basket positioned between said first and second side plate inner faces proximate to each said top edge thereof; and a lift frame adapted for attachment to a towing vehicle;

wherein said drag pipe is constructed and arranged to allow for an amount of sand to be built up between the tines and the drag pipe which is effective to prevent seaweed or other debris from escaping past the tines and exiting from the rear of the unit upon being pulled along a sand beach, whereby debris is removed from the sand's surface leaving behind a smooth surface that is free of ruts.

* * * * *